US005983526A

United States Patent [19]

Pawlik et al.

[11] Patent Number: 5,983,526

[45] Date of Patent: Nov. 16, 1999

[54] IMPERVIOUS SHOECOVERS

[75] Inventors: Colette R. Pawlik, Kenosha, Wis.; Jennifer L. Grossi, Arlington Heights, Ill.; Betty F. McDaniel, El Paso, Tex.

[73] Assignee: Allegiance Corporation, McGaw Park, Ill.

[21] Appl. No.: 08/918,236

[22] Filed: Aug. 25, 1997

[51] Int. Cl.[6] ..... A43B 3/18

[52] U.S. Cl. ..... 36/7.1 R; 36/51

[58] Field of Search ..... 36/7.1 R, 8.1, 36/8.2, 51, 2 R

[56] References Cited

U.S. PATENT DOCUMENTS 4,019,265 4/1977 Epstein .
4,083,124 4/1978 Michalak .
4,335,527 6/1982 Pask .
4,598,485 7/1986 Joe et al. .
4,616,429 10/1986 Alcala .
4,918,839 4/1990 Brandon .
5,228,215 7/1993 Bayer .
5,325,541 7/1994 Willard .

*Primary Examiner*—Ted Kavanaugh
*Attorney, Agent, or Firm*—Paul E. Schaafsma; Kay H. P. Hannafan

[57] ABSTRACT

The present provides impervious shoecovers primarily for use in medical applications. The shoecovers have a boot which define an inside area, and an elastic band attached to an ankle section of the boot. The boot has a top which defines a foot opening to the inside area, and a bottom opposite of the top. The ankle section is positioned between the top and the bottom. The elastic band is attached to a flap at the ankle section of the boot which extends beyond a fluid resistant seal and thus, leaves the ankle section free of perforations to the inside area. The shoecover is made from a fluid resistant or impervious material.

18 Claims, 2 Drawing Sheets

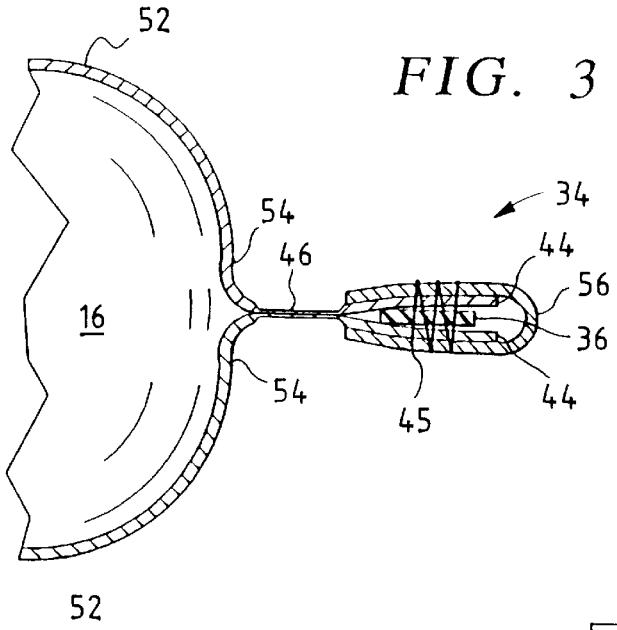
FIG. 3
FIG. 5
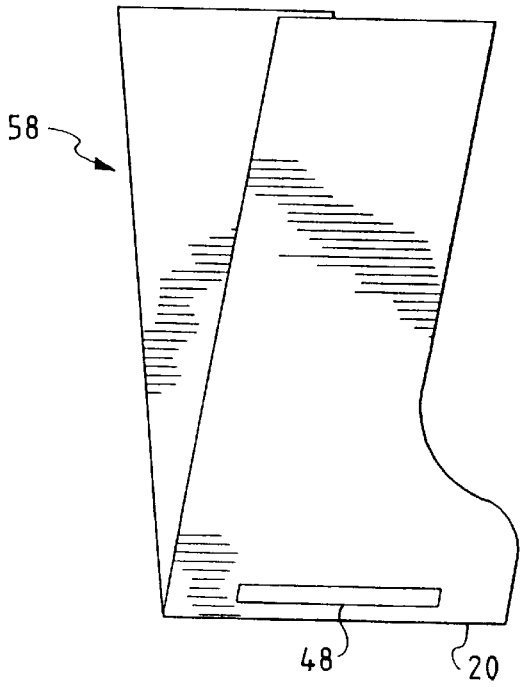
FIG. 4
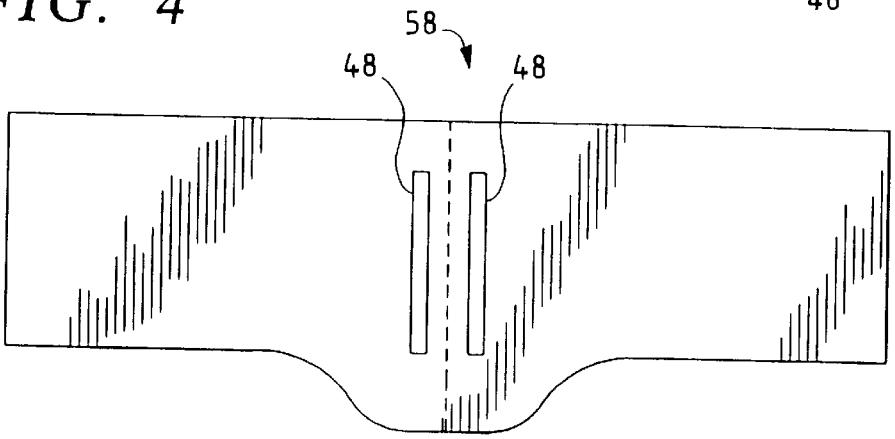

IMPERVIOUS SHOECOVERS

FIELD OF THE INVENTION

The present invention generally relates to shoecovers and more specifically, the present invention relates to impervious shoecovers for use in medical applications.

BACKGROUND OF THE INVENTION

Protective shoecovers are commonly used for medical applications. For example, protective shoecovers have been used during surgical procedures to protect the wearer. The shoecovers protect the wearer's foot, ankle, and lower leg by reducing the potential of surgical fluids and other surgical debris from coming into contact with those parts of the wearer's body.

Existing protective shoecovers for use in medical applications have included an elastic strip sewn into the shoecover around an ankle area. When the shoecover is worn the sewn-in elastic strip gathers the shoecover around the wearer approximately in the area of the wearer's ankle. Because the elastic strip is sewn into the shoecover holes or perforations are created in the shoecover. Accordingly, it would be advantageous to have a protective shoecover in which an elastic ankle strip is attached to the shoecover without creating perforations through the shoecover.

SUMMARY OF THE INVENTION

The present invention provides new impervious shoecovers for protecting a wearer's body. The new impervious shoecovers are particularly suited for medical applications to reduce the risk of the wearer's body coming in contact with various fluids, surgical debris, microorganisms and the like. The impervious shoecovers are also suited for use in reducing the risk of the wearer contaminating or compromising a sterile field or clean area around the wearer.

One shoecover according the present invention includes a boot defining an inside area The boot has a top that defines a foot opening to the inside area, a bottom opposite of the top and an ankle section between the top and bottom. The ankle section is formed from a flexible fabric. An elastic band extends around the ankle section of the boot and is attached to the ankle section while leaving the ankle section free of perforations to the inside area. Preferably, the boot is substantially comprised of a fluid resistant or impervious fabric to protect the wearer from undesirable fluids, debris, and microorganisms. The elastic band may be attached to a flap on the boot which is outside of a fluid resistant seal of the boot. The shoecover may also have additional elastic attached to the boot at various locations to provide the boot with a more secure fit on the wearer. The additional elastic can also be attached to the shoecover without creating perforations through the boot to the inside area. An anti-skid area may be provided on the bottom of the boot.

One new medical shoecover according to the present invention includes a fluid penetration resistant fabric folded upon itself to form two halves of a boot having front and back edges. The fabric is folded along the bottom of the boot. The front edges of the two halves of the boot are sealed together along a front fluid resistant seal and the back edges of the two halves of the boot are sealed together along a back fluid resistant seal. A flap extends beyond at least one of the front and back fluid resistant seals. An elastic band is attached to the flap and extends around an outside of the boot.

One method of making a medical shoecover according to the present invention includes providing a single sheet of fluid penetration resistant fabric in the shape of two sides of a boot. The two sides of the boot are contiguously connected at a bottom portion of the single sheet of fabric. The single sheet of fabric is folded upon itself along the bottom portion and is sealed along front and back seals to form the boot which has an interior area. An elastic band extending around the boot is attached on the ankle section of the boot without creating perforations to the interior area. The elastic band may be attached to a flap extending beyond one of the front and back seals in the ankle section.

The new impervious shoecovers provide a convenient, cost effective way of maling shoecovers and protecting the shoecover wearer. The shoecovers include an elastic band around an ankle section in which the elastic band is attached to the shoecover without creating perforations to the protected area inside the shoecover.

An advantage of the present invention is to provide impervious shoecovers which can be utilized to protect the wearer and/or the environment surround the wearer, for example, in medical applications.

Another advantage of the present invention is to provide shoecovers which reduce or eliminate perforations through the shoecover to an inside area of the shoecover.

Another advantage of the present invention is provide shoecovers having an elastic band around an ankle section in which the elastic band is attached to the shoecover without creating perforations through the shoecover to an inside area of the shoecover.

Other objects and advantages of the present invention will become apparent upon reading this disclosure including the appended claims with reference to the accompanying drawings.

BRIEF DESCRIPTION OF THE DRAWING

FIG. 3 is a cross-sectional view of an outer edge of the shoecover of FIG. 1.

FIG. 4 is a plan view of a fabric used to make the shoecover of FIG. 1.

FIG. 5 is a perspective view of the fabric of FIG. 4 folded to make the shoecover of FIG. 1.

DETAILED DESCRIPTION OF PRESENTLY PREFERRED EMBODIMENTS

Although the present invention can be made in many different forms, the presently preferred embodiments are described in this disclosure and shown in the attached drawings. This disclosure exemplifies the principals of the present invention and does not limit the broad aspects of the invention only to the illustrated embodiments.

Figure 1:
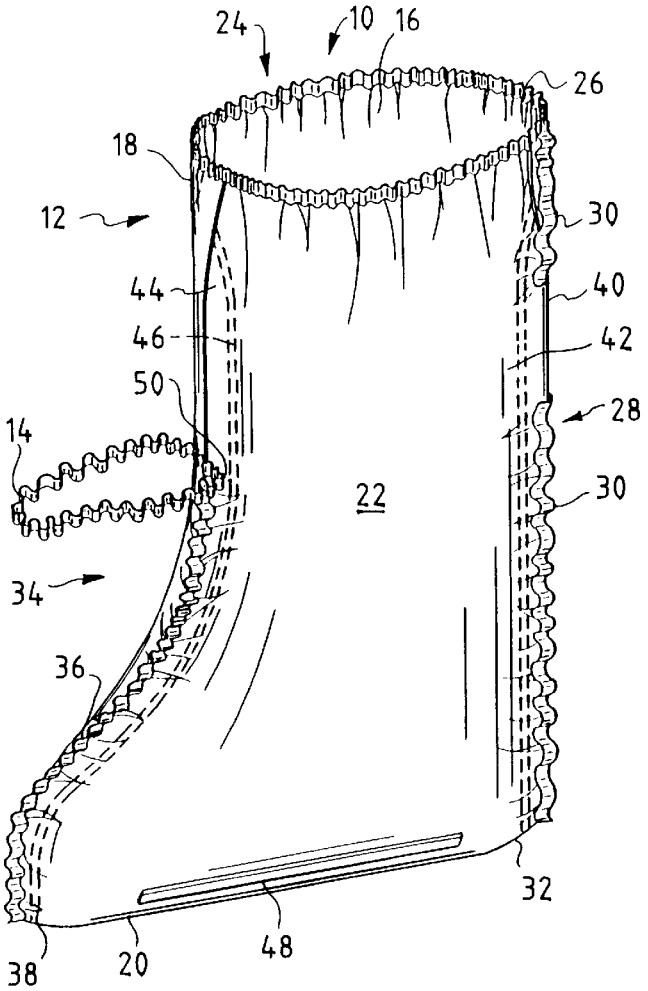
FIG. 1 is a perspective view of a shoecover according to the principles of the present invention.

A new shoecover 10 according to the principles of the present invention is shown by the way of example in FIG. 1. The shoecover 10 includes a boot 12 and an elastic band 14 attached to the boot 12 without creating perforations through the boot to an inside area 16 of the boot 12. The boot 12 has a top 18, a bottom 20 opposite the top 18 and an ankle section 22 between the top 18 and the bottom 20. A foot opening 24 is provided at the top 18 to access the inside area 16 of the shoecover 10. When the shoecover 10 is worn, the wearer's foot or shoe is positioned inside the shoecover 10 at the bottom 20. The ankle section 22 will be positioned approximately in the area of the wearer's ankle and the top 18 will be positioned above the wearer's ankle and around the wearer's leg. The elastic band 14 will be positioned around the ankle section 22 (see FIG. 2) to gather the shoecover 10 close to the wearer.

The elastic band 14 is shown in FIG. 1 extending away from the boot 12 (nonuse position) for clarity because in that embodiment the elastic band 14 is only attached to the front of the boot 12. The remaining portion of the elastic band 14 is free from attachment to the boot 12.

The boot 12 of the shoecover 10 has a piece of elastic 26 attached at the top 18 and extends around the foot opening 24. The piece of elastic 26 at the top 18 of the shoecover 10 closes the foot opening 24 around the leg of the wearer and gathers the top 18 close to the wearer for a good fit.

A back side 28 of the boot 12 may also have a piece of elastic 30. The piece of elastic 30 on the back side 28 may extend from the top 18 down to a heel section 32 or any length along the back side 28. A portion of the piece of elastic 30 is shown broken away from the boot 12 in FIG. 1 for clarity. The piece of elastic 30 on the back side 28 also acts to conform the shoecover 10 to the wearer and provide a good fit.

A front side 34 of the boot 12 may also have a piece of elastic 36. The piece of elastic 36 on the front side 34 may extend from the top 18 down to a toe section 38. Similar to the piece of elastic 26 on the top 18 and the piece of elastic 30 on the backside 38, the piece of elastic 36 on the front side 34 assists in properly conforming the shoecover 10 to the wearer. The pieces of elastic 26, 30, 36 may extend only partially or entirely along their respective top 18, backside 28 and front side 34 as may be desired. For example, the piece of elastic 36 on the front side 34 may extend only from the toe section 38 at the bottom 20 up to the location where the elastic band 14 is attached to the ankle section 22. Preferably, the piece of elastic 30 on the back side 28 is attached to a back flap 40 which extends from the boot 12 beyond a back seal 42. Similarly, the piece of elastic 36 on the front side 34 may be attached to a front flap 44 which extends from the boot 12 beyond a front seal 46. Because the back and front flaps 40,44 are outside of the back and front seals 42,46 the pieces of elastic 30,36 can be sewn into the back and front flaps 40,44 without providing perforations through the boot 12 to the protected inside area 16.

One or more anti-skid strips 48 may be attached to the bottom 20 of the boot 12. The anti-skid strips 48 provide the wearer with increased traction when wearing the shoecover 10. The anti-skid strip 48 may be a foam strip adhesively bonded to the bottom 20 of the boot 12, for example.

Figure 2:
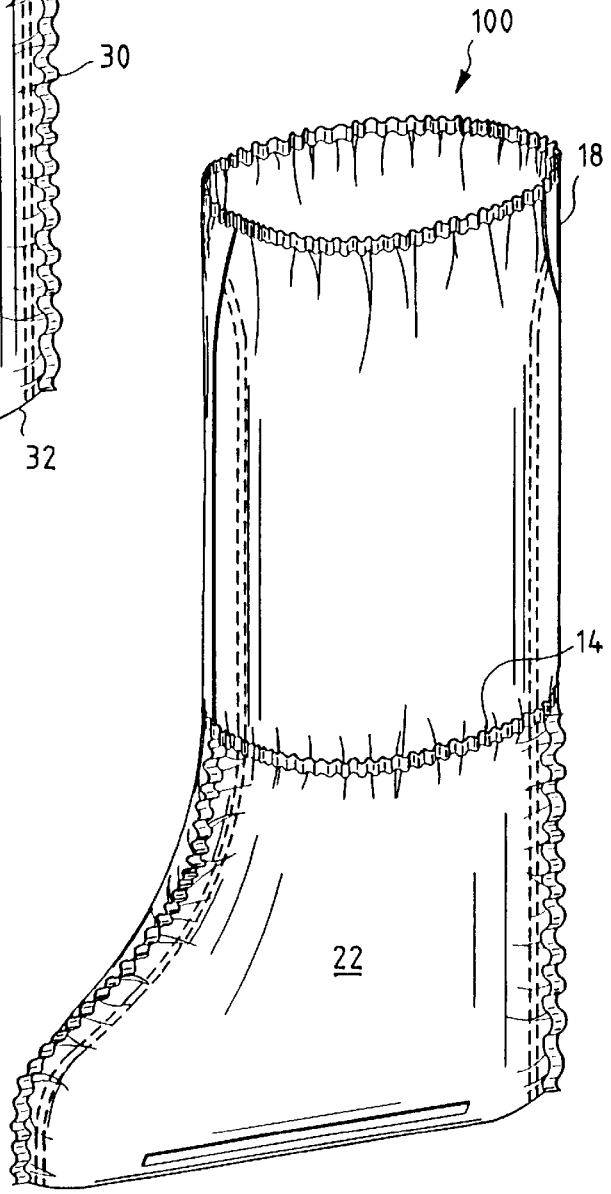
FIG. 2 is a perspective view of another shoecover according to the principles of the present invention.

FIG. 1 shows one example of attaching the elastic band 14 to the shoecover 10 according to the present invention. In this embodiment, an end 50 of the elastic band 14 is attached to the front flap 44 on the front side 34 of the boot 12. Because the end 50 of the elastic band 14 is attached to the front flap 44 outside of the front seal 46 the end 50 can be sewn to the front flap 44 without creating perforations through the boot 12 to the inside area 16. The elastic band 14 is shown as being attached to the boot 12 in the area of the ankle section 22. This location of the elastic band 14 assists in conforming the shoecover 10 to the wearer and providing a good, comfortable fit. The elastic band 14 is shown in FIG. 1 as removed from being around the boot 12. This shows that the elastic band 14 is loose from the boot 12 except for the end 50 being attached to the front flap 44. Referring to FIG. 2, a high-top shoecover 100 is shown with the elastic band 14 in position for wearing the shoecover 100. The elastic band 14 of the shoecover 10 in FIG. 1 is positioned around the ankle section 22 when the shoecover 10 is worn similar to the position of the elastic band 14 shown in FIG. 2.

The elastic band 14 may be attached to the boot 12 by other methods which also do not form perforations through the boot 12 to the inside area 16 of the shoecover 10. For example, the elastic band 14 could be attached to the back flap 40 on the back side 28 rather than attached to the front flap 44 on the front side 34. The elastic band 14 could be attached to the boot 12 by methods other than stitching. Such other methods may include heat sealing and ultrasonic sealing of the elastic band 14 to the boot 12, particularly in the area of the ankle section 22. The elastic band 14 may be tack bonded to the boot 12 at various locations around the boot 12, particularly around the ankle section 22. The material used to cover the elastic band 14 and the material used for the boot 12 must be compatible for heat sealing or ultrasonic sealing if those methods of attachment are used.

FIG. 3 shows a cross-sectional view of the front side 34 of the boot 12. The boot 12 has a pair of sides 52 (i.e., two halves) which terminate in front edge portions 54. The front seal 46 bonds the front edge portions 54 together at a location that creates the front flap 44. The front seal 46 is a fluid resistant seal and preferably, a fluid impervious seal. The front seal 46 can be created by any sealing method acceptable for medical applications. For example, the front seal 46 may be formed by an ultrasonic sealing method or a heat sealing method. The piece of elastic 36 is conveniently attached to the front flap 44 by stitching 45; however, other methods of attachment may also be used. Because the piece of elastic 36 is attached to the front edge portions 54 outside of the front seal 46, any perforations through the front flap 44 do not extend into the inside area 16 of the shoecover 10. An edge cover 56 may also be attached to the front flap 44 to cover the piece of elastic 36 and provide for a visibly pleasing appearance of the shoecover 10. The edge cover 56 also protects the piece of elastic 36 which can be made from latex. The back side 28 of the boot 12 has a construction similar to the construction of the front side 34 as discussed above. The elastic band 14 (FIG. 1) preferably includes an edge cover covering the elastic similar to the edge cover 56. Also, an edge cover is provided at the top 18 to cover the top piece of elastic 26. The top piece of elastic 26 may be sewn to the top 18 and perforations through the boot 12 at the top 18 are acceptable in view of the foot opening 24.

Referring to FIGS. 4 and 5, the boot 12 is formed from a single piece of flexible fabric 58 folded upon itself along the bottom 20 of the boot 12. The one piece folded construction of the boot 12 provides for no seam at the bottom 20 which is generally a high-intensive fluid contact area of the shoecover 10. Further, no seams or seals are stressed on the bottom 20 of the shoecover 10 during use by the wearer. Other fluid resistant or impervious films in fabric layers which serve the purposes of the shoecover 10 could be used with the present invention. The fabric 58 is resistant to fluid penetration and preferably is impervious to fluid penetration. Fabric 58 may also resist or prevent penetration of microorganisms. One fabric 58 suitable for use in the present inventionis a multi-layered fabric. The multi-layered fabric 58 may include a first layer of fluid resistant or impervious film such as polyethylene and a second fabric layer such as spunbonded polypropylene fabric. The polyethylene film and the spunbonded polypropylene fabric can be hot-melt laminated to each other. The multi-layered fabric 58 is folded along the bottom 20 such that the fluid impervious film is on the inside of the shoecover 10 (i.e., facing the wearer) and the fabric layer is on the outside of the shoecover 10. The fabric layer provides an aesthetically pleasing shoecover and may also provide some skid resistance.

Referring to FIG. 1, the elastic band 14 could be replaced with a pair of ties attached to one of either the front side 34 or the back side 28. The ties can be brought around the ankle section 22 and tied together to conform the shoecoyer 10 to the wearer, The elastic band 14 provides advantages over ties such as ease of donning the shoecover 10 by the wearer.

The shoecover 10 shown in FIG. 1 is a low-top embpdime.nt of the present invention, and the shoecover 100 shown in FIG. 2 is a high-top embodiment. The low-top shoecover 10 (FIG. 1) covers a wearer's foot with a top 18 extending somewhat above the wearer's ankle. The height of the high-top shoecover 100 (FIG. 2) is greater is than the height of the low-top shoecover 10. Thus, the high-top shoecover 100 covers a larger portion of the wearer's leg above the wearer's ankle.

The new shoecover 10 is made and used as follows. Referring to FIG. 4, the single piece of fabric 58 is cut in the shape of two sides of a boot contiguously connected in a bottom 20 of the boot. The single piece of fabric 58 is folded upon itself along the bottom 20 of the boot, as shown in FIG. 5. Referring to FIGS. 1–3, the folded fabric 58 is sealed along the front seal 46 and the back seal 42 to form the boot 12 having the inside area 16. The elastic band 14 is attached to the ankle section 22 around the boot 12 without creating perforations through the boot 12 to the inside area 16. For example, the elastic band 14 may be sewn into the front flap 44. The pieces of elastic 26,30,36 may be attached to the boot 12 as discussed above and shown in FIG. 1. A pair of anti-skid strips 48 are attached to the bottom 20 of the boot 12.

A wearer dons the shoecover 10 by opening the foot opening 24 in the top 18 and sliding the shoecover 10 over the wearer's foot. Preferably, the elastic band 14 is extending around the ankle section 22 as shown in FIG. 2. As the wearer slides the shoecover 10 over the foot, the foot slips past the elastic band 14 and rests on the inside of the bottom 20. The top 18 is pulled upward above the wearer's ankle. The elastic band 14 gathers the shoecover 10 around the wearer's ankle and provides for a good, comfortable fit. The pieces of the elastic 26,30,36 at the top 18, back side 28 and front side 34, respectfully, also conform the shoecover 10 to the wearer and provide a good, comfortable fit.

While the presently preferred embodiments have been illustrated and described, numerous changes and modifications can be made without significantly departing from the spirit and scope of this invention. Therefore, the inventors intend that such changes and modifications are covered by the appended claims.

What is claimed is:

1. A shoecover comprising:

a boot (12) defining an inside area, the boot having a top (18) which defines a foot opening to the inside area, a bottom (20) opposite of the top, and an ankle section (22) between the top and bottom, the ankle section being formed from a flexible fabric; and a piece of elastic having ends (50), both of said ends (50) being attached to the ankle section of the boot to form an elastic band, the elastic band extending around the ankle section of the boot and being loose from the boot except for ends (50).

2. The shoecover of claim 1 wherein the elastic band is attached to a flap on the boot which is outside of a fluid resistant seal between two portions of the boot.

3. The shoecover of claim 1 wherein the elastic band is attached to the ankle section by one end of the elastic band.

4. The shoecover of claim 1 wherein the elastic band extends around an outside of the ankle section.

5. The shoecover of claim 1 wherein the boot is substantially comprised of a fluid resistant fabric.

6. The shoecover of claim 5 wherein the fluid resistant fabric comprises a first layer of fluid resistant film bonded to a second fabric layer.

7. The shoecover of claim 6 wherein the first layer of fluid resistant film is a polyethylene film and the second fabric layer is a spunbonded polypropylene fabric, the first and second layers being hot-melt laminated to each other.

8. The shoecover of claim 1 further comprising an anti-skid area on the bottom of the boot.

9. The shoecover of claim 1 wherein the boot further comprises:

a top elastic portion at the top of the boot;

a back elastic portion extending along a back side of the boot; and a front elastic portion extending along a front side of the boot.

10. The shoecover of claim 9 wherein the front elastic portion extends from the elastic band down to a toe section of the boot.

11. The shoecover of claim 1 wherein the boot is made from a single sheet of the flexible fabric folded at the bottom of the boot to form left and right sides, the left and right sides joined together along a front fluid resistant seal and a back fluid resistant seal.

12. The shoecover of claim 11 wherein the front and back fluid resistant seals are selected from the group consisting of heat seals and ultrasonic seals.

13. The shoecover of claim 1 wherein the boot is a low-top boot.

14. The shoecover of claim 1 wherein the boot is a high-top boot.

15. A medical shoecover comprising:

a fluid penetration resistant fabric folded upon itself to form two halves of a boot having front and back edge portions, the fabric folded along a bottom of the boot;

front and back fluid resistant seals extending along the front and back edge portions, respectively;

a flap extending beyond at least one of the front and back fluid resistant seals; and an elastic band having ends 50 attached to the flap and said band 10 extending around an outside of the boot and being loose from the boot except for ends 50.

16. The medical shoecover of claim 15 further comprising:

front and back flaps extending beyond the front and back fluid resistant seals, respectively;

a front elastic member attached to and extending along at least a portion of the front flap;

a back elastic member attached to and extending along at least a portion of the back flap; and a top elastic member attached to a top of the boot opposite the bottom, the top elastic member adjacent a foot opening defined by the top of the boot.

17. The medical shoecover of claim 16 wherein the fluid penetration resistant fabric comprises a layer of fluid resistant polyethylene film bonded to a spunbonded polypropylene fabric layer.

18. The shoecover of claim 16 further comprising an anti-skid strip attached to the bottom of the boot.

* * * * *